US009764381B2

(12) United States Patent
Digard Brou De Cuissart et al.

(10) Patent No.: US 9,764,381 B2
(45) **Date of Patent: *Sep. 19, 2017**

(54) LINED MOLD FOR CENTRIFUGAL CASTING

(71) Applicant: Safran Aircraft Engines, Paris (FR)

(72) Inventors: Sébastien Digard Brou De Cuissart, Moissy-Cramayel (FR); Valéry Piaton, Moissy-Cramayel (FR); Marc Soisson, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/115,148

(22) PCT Filed: Jan. 29, 2015

(86) PCT No.: PCT/FR2015/050208

§ 371 (c)(1),
(2) Date: Jul. 28, 2016

(87) PCT Pub. No.: WO2015/114262

PCT Pub. Date: Aug. 6, 2015

(65) Prior Publication Data

US 2016/0339511 A1 Nov. 24, 2016

(30) Foreign Application Priority Data

Jan. 31, 2014 (FR) ..... 14 50799

(51) Int. Cl.
*B22D 13/10* (2006.01)

(52) U.S. Cl.
CPC ..... *B22D 13/102* (2013.01); *B22D 13/101* (2013.01)

(58) Field of Classification Search
CPC ..... B22D 13/101; B22D 13/102
USPC ..... 164/286, 289, 290, 296
See application file for complete search history.

(56) References Cited

U.S. PATENT DOCUMENTS

| | | | | |
|---|---|---|---|---|
| 2,378,042 | A * | 6/1945 | Sorensen | B22D 13/066 164/290 |
| 4,031,947 | A * | 6/1977 | Connolly | B22D 5/02 164/114 |
| 6,443,212 | B1 | 9/2002 | Choudhury et al. | |
| 6,776,214 | B2 * | 8/2004 | Ray | B22D 13/00 164/267 |
| 2005/0011627 | A1 * | 1/2005 | Noble | B22D 13/02 164/114 |
| 2016/0339512 | A1 * | 11/2016 | Guillaume | B22D 13/101 |

FOREIGN PATENT DOCUMENTS

EP 0 992 305 A1 4/2000

* cited by examiner

*Primary Examiner* — Kevin E Yoon
(74) *Attorney, Agent, or Firm* — Blank Rome LLP

(57) ABSTRACT

The invention relates to a rotary mold for centrifugal casting of an alloy. The mold comprises liners (135*a*) housed in hollow exoskeletons (137*a*). The exoskeletons retain the liners against the centrifugal force, during the casting, while the mold is spinning.

10 Claims, 5 Drawing Sheets

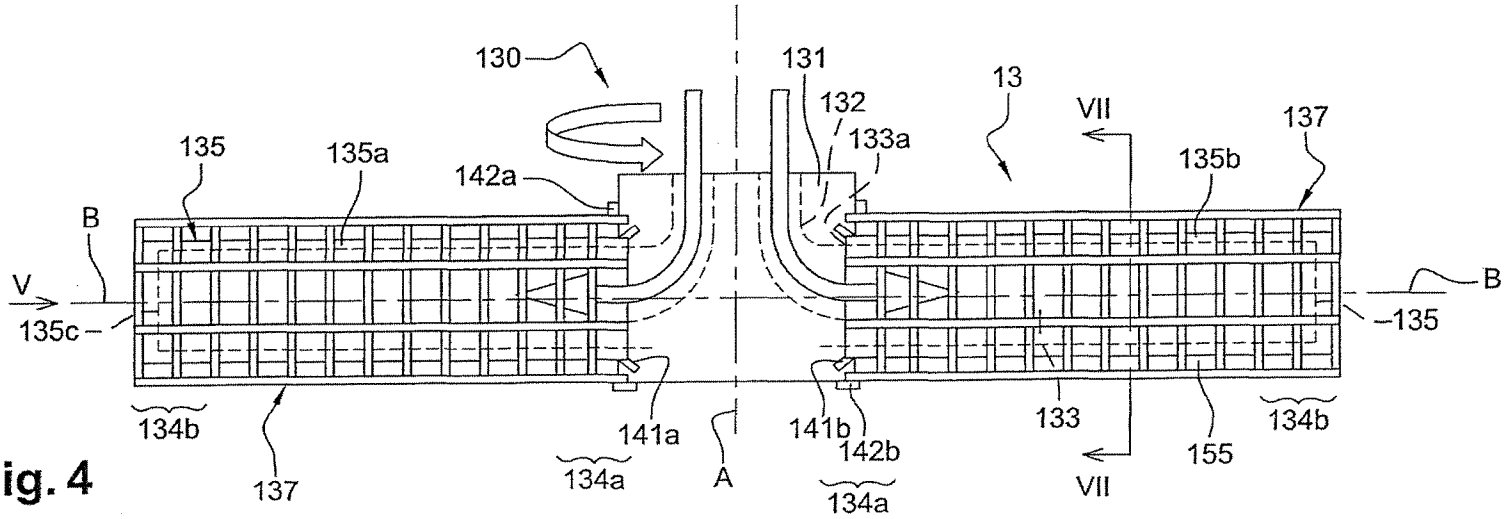
Fig. 4
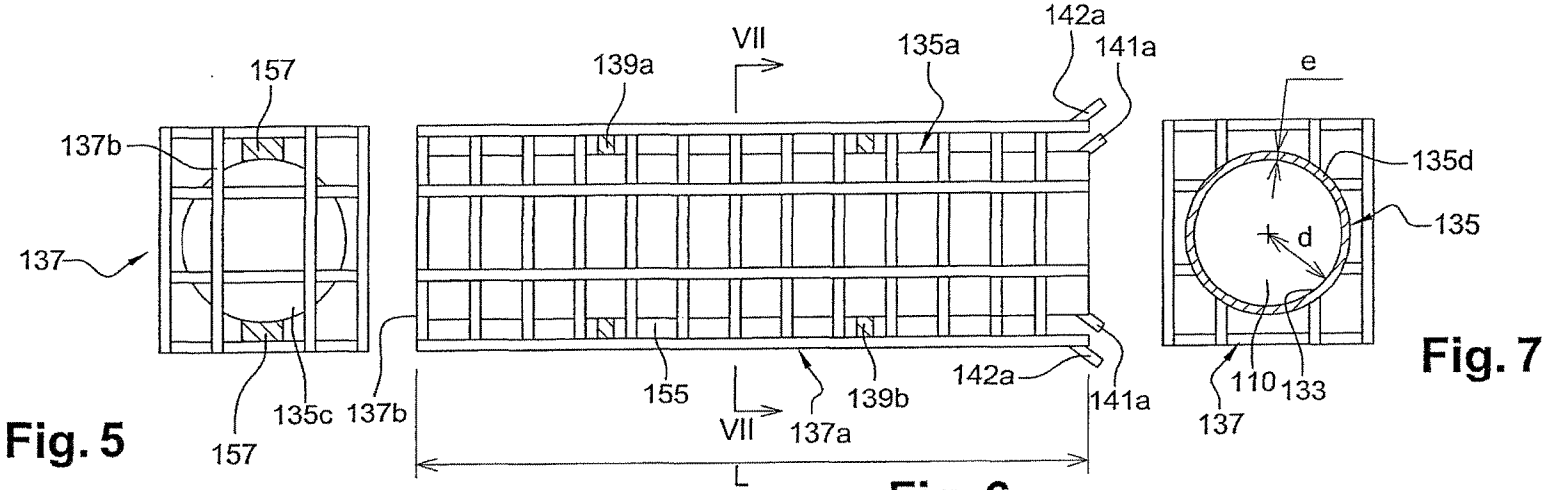
Fig. 7
Fig. 6
Fig. 5

LINED MOLD FOR CENTRIFUGAL CASTING

The present invention relates to a mold for manufacturing metal pieces by centrifugal casting, and in particular for manufacturing turbomachinery blades. The present invention is particularly suitable for blades of a turbine wheel of an aircraft turbojet or turbofan, or of an aircraft turboprop.

It is known that turbomachinery blades can be made by machining blanks obtained by casting a metal alloy. Such a blank is typically a bar that is solid and elongate in general shape, and that is machined through its thickness to form the final geometrical shape of the blades.

One of the techniques for obtaining such a blank consists, as in EP 992305, in using a rotary mold suitable for spinning about an axis (A), for manufacturing it by centrifugal casting of an alloy, such a mold comprising:

a plurality of liners, each defining a recess for receiving the alloy, and extending radially about said axis (A); and at least one exoskeleton in which the liners are disposed, said at least one exoskeleton retaining such liners against a centrifugal force.

A (first) problem to be solved concerns controlling the speed of cooling for facilitating obtaining a controlled microstructure, such as aluminum content that is uniform throughout the piece, in particular if the alloy is based on titanium aluminide (TiAl).

As regards manufacturing bars by casting in a centrifugal casting permanent mold, it should also be noted that the casting conditions give rise to a second problem, namely rapid wear of the molds, which requires them to be changed often, which is expensive and has an impact on manufacturing conditions, in particular throughput rates. This also has an impact on the shapes given to the molds, and thus to the molded pieces.

The present invention makes it possible to remedy at least some of the above-mentioned drawbacks in simple, effective, and inexpensive manner.

To this end, it proposes that, transversely to the radial direction (B) in which each liner extends, a space exists peripherally between said liner and the exoskeleton that surrounds it.

Thus, not only is it possible to dissociate the physical characteristics of the exoskeleton(s) from the physical characteristics of the liners that may in particular be of small thickness and/or of a material different from the material of the exoskeleton(s), but also it is possible to manage thermal inertia favorably, with a view to facilitating uniform cooling of the shape of the cast alloy. Making provision for the space between said liner and the exoskeleton to be defined within a cellular structure extending peripherally between each liner and the exoskeleton that surrounds it typically makes it possible to come closer to achieving the above objects, including by this box structure, facilitating the desired resistance to mechanical forces, and in particular facilitating retaining the liners during the centrifugal casting.

Implementing the exoskeletons in an open-work configuration also facilitates such mechanical resistance to the forces related to the spinning for the centrifugal casting. Therein also lies an advantage with regard to thermal inertia, which is then lower than if the same exoskeleton(s) were made with uninterrupted walls.

In addition and preferably:

a fastening that may be releasable is established between each liner and the exoskeleton that surrounds it; and/or the mold further comprises a central block having ducts via which the alloy is cast, and which communicate with the insides of the liners, a releasable fastening then being established between the central block and each liner and/or the exoskeleton that surrounds it.

Thus, in particular when wear so requires, it is possible to replace the liners (e.g. about every 25 castings), while also maintaining the liners in the meantime.

The liners can be changed at lower cost, while the remainder of the structure of the mold, in particular the exoskeleton(s), can be kept.

In this context, it is thus recommended that the exoskeletons and the liners be designed so that the mold is permanent, the liners thus needing to withstand several castings in succession (e.g. about 25).

Regarding, once again, controlling the thermal inertia making it possible for the metal shape coming from the mold to cool in uniform manner, and in particular making it possible for the speed of cooling to be controlled, which is essential in order to obtain an aluminum content that is uniform throughout a piece made of a metal alloy based on TiAl and thus a microstructure that is controlled, it is also recommended that the liners of the mold that then enclose such a cast metal alloy of TiAl be made of steel, of a metal alloy, and/or of a ceramic, and thus be adapted for said alloy to be cast in them in the molten state by centrifugal casting.

It is also recommended for at least one thermally insulating structure to extend peripherally between each liner and the exoskeleton that surrounds it.

Thus, the or each exoskeleton may be in a very simple form, that is not worked or little worked for the desired control of the thermal inertia, all the more so if said thermally insulating structure is of cellular or honeycomb configuration. It should also be noted that, by means of its box structure, such a solution typically makes it possible to facilitate withstanding mechanical forces, and in particular retaining the liners during the centrifugal casting.

Such is an expected effect if, as recommended, the liner in question and the cellular structure, which includes walls separating the cavities, bear against each other or meet via discrete zones, this also being beneficial to controlling the thermal inertia.

It is possible to obtain good mechanical strength by transferring forces via said walls separating the cavities, and also, if necessary, to insulate the liner thermally from the exoskeleton(s), via a suitable material and via one or more suitable shapes.

In order to further facilitate such resistance to forces, it is recommended that the structure in question define some of said centering means that thus position the liner in question relative to the exoskeleton.

In addition, in order to further facilitate replacing the liners, in terms of ease of handling and/or of time spent, and of costs, it is preferred for the molds to be of a modular nature, so that the liner, the cellular and/or thermally insulating structure that surrounds it, and the exoskeleton that surrounds said structure are three elements that are mutually dissociable, the liner and the thermally insulating structure being engaged in the exoskeleton concentrically. Including for facilitating taking account of the issues of: controlling firstly the forces and secondly the temperature constraints, it is also proposed that, with the liners individually having an inside surface that delimits the/a central duct for casting the alloy, a radially outer end portion of said duct is provided with a shoulder.

Other advantages and characteristics of the invention will appear on reading the following description given by way of non-limiting example and with reference to the accompanying drawings, in which.

Figure 3:
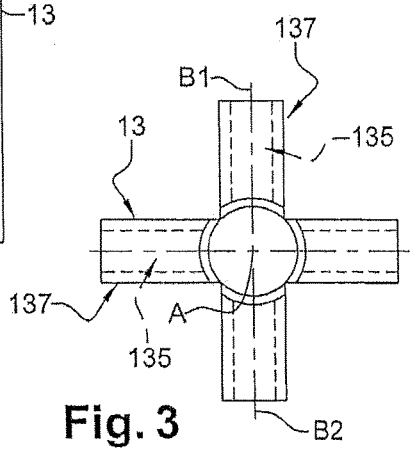
Figure 12:
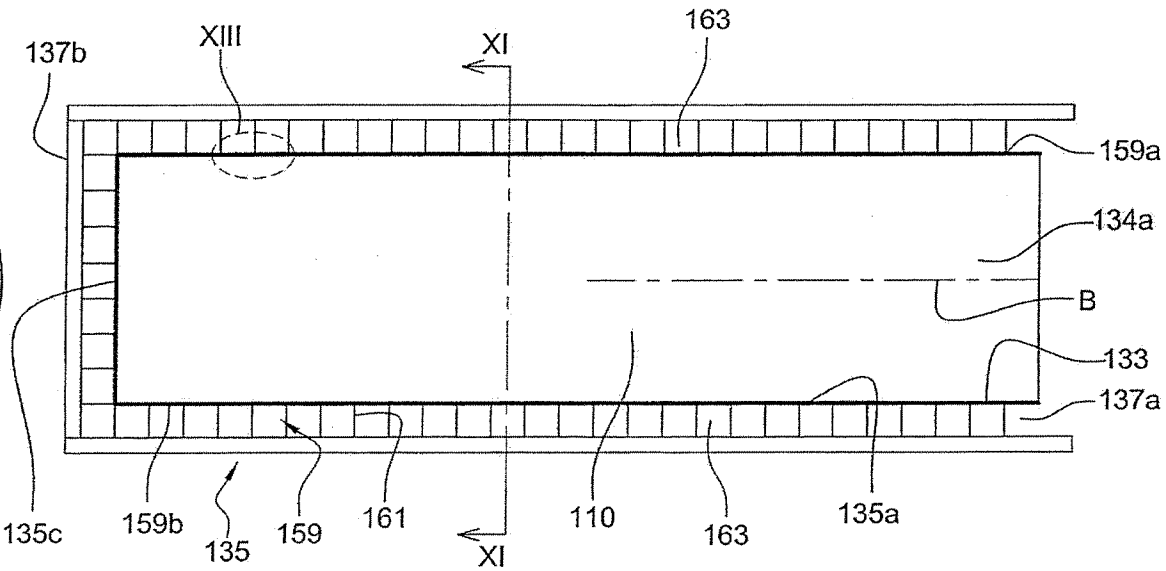
Figure 13:
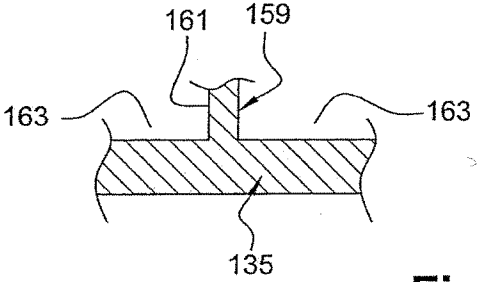
Figure 14:
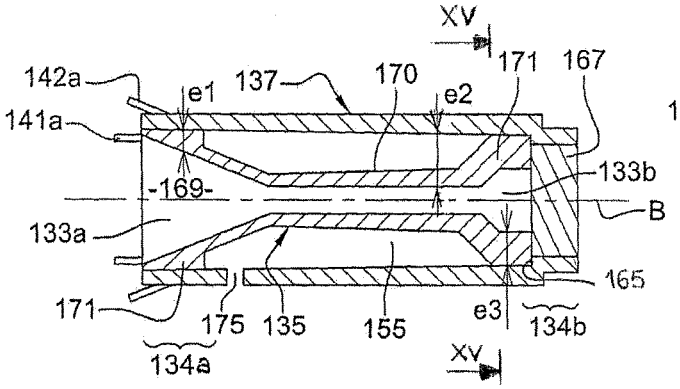

FIG. 3 is a diagrammatic view from above of a mold having liners and exoskeletons, and in which bars having less segregation are to be molded; and FIGS. 4, 5, 6, 7, 8, 9, 10, 11, 12, 13, 14, and 15 diagrammatically show liners and exoskeletons in various embodiments, in front views (FIGS. 4 and 6), in diagrammatic longitudinal section views (showing one of the radial axes B; FIGS. 12 and 14), or cross-section views (FIG. 7, section on VII-VII, FIG. 11, section on XV-XV, FIG. 15), and side views (FIG. 5, seen along V, and FIGS. 8, 9, and 10), FIG. 13 being a detail of a variant embodiment of zones identical to the zone referenced XIII in FIG. 12.

Figure 1:
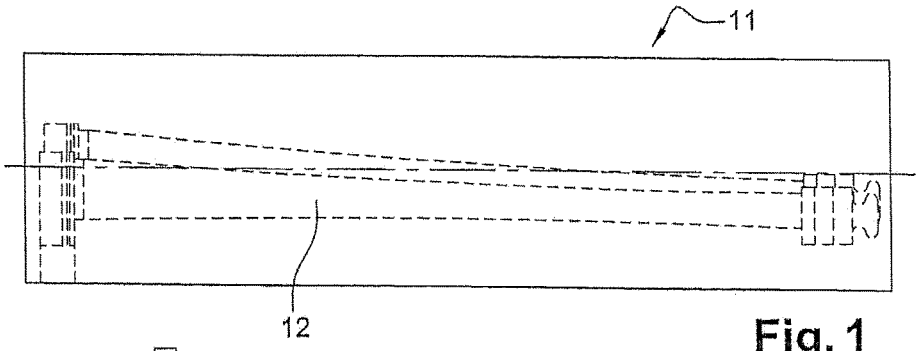
Fig. 1 Prior Art
FIG. 1 is a diagrammatic front view of a prior art solid cylindrical bar from which turbomachinery blades are to be machined.

FIG. 1 shows a metal bar 11 made of a casting and from which at least one turbine blade, and in this example two turbine blades 12 for a piece of turbomachinery are designed to be machined.

The bar 11 may have a cylindrical shape and is solid. It is obtained by casting a metal alloy in a mold.

Figure 2:
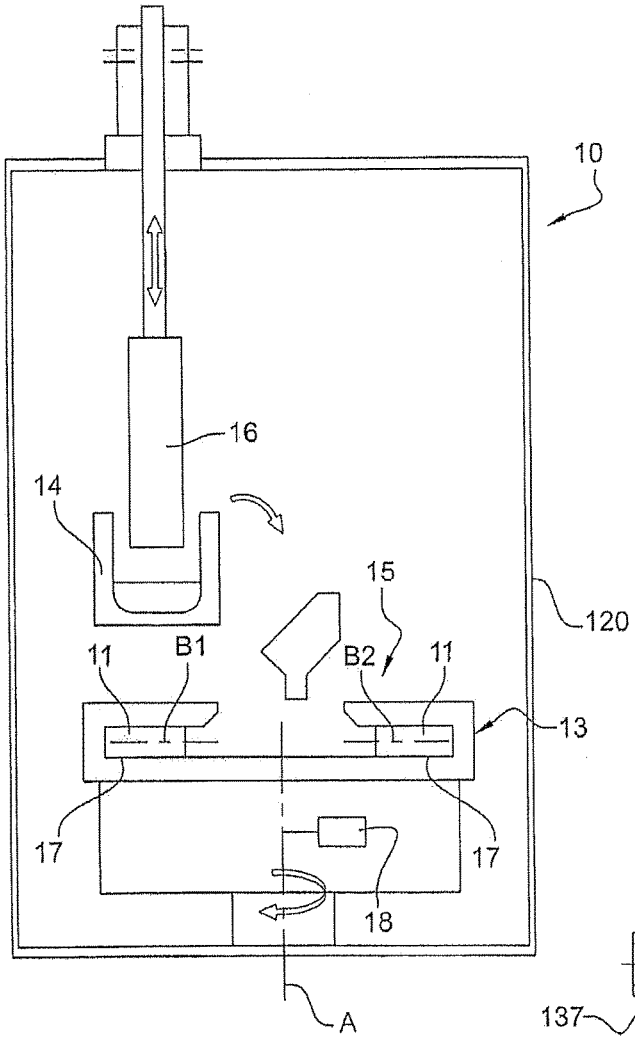
Fig. 2 Prior Art
FIG. 2 is a diagrammatic view of a prior art mold.

FIG. 2 shows conventional apparatus 10 for manufacturing bars or blanks 11, by implementing successive melting, casting, and molding operations.

The apparatus 10 includes an closed and sealed enclosure 120 inside which a partial vacuum is applied. An ingot 16 made of a metal alloy, in this example containing aluminum, and more precisely in this example based on TiAl, is firstly melted in a melting pot 14. In the molten state, it is poured into a permanent metal mold 13.

The mold 13 makes it possible to cast the alloy by centrifugal casting, in order to obtain bars 11. For this purpose, it is caused to spin about a vertical axis A. The mold 13 is provided with a plurality of recesses 17, which are, for example, cylindrical and of circular section, and which extend radially (axes B1, B2; FIGS. 2, 3) about the axis A, preferably via a motor 18. These cavities are preferably regularly spaced apart angularly about the axis A, which is vertical in this example. The centrifugal forces generated by the mold rotating force the molten alloy to penetrate into said recesses and to fill them. Thus, the alloy to be cast, brought to the center of the mold, spreads towards the cavities.

After cooling, the mold 13 is taken apart and the molded bars 11 are extracted. The walls of the mold that surround the recesses 17 for receiving the metal have large thicknesses so as to withstand the centrifugal forces, which are typically more than 10 g-forces (g).

These thicknesses can lead to high thermal inertia or temperature lag, and can generate high temperature gradients during cooling of the cast metal, causing a difference in the microstructure of the bar in the vicinity of its center relative to the microstructure in the vicinity of its periphery. The parts made from the bars 11 can thus have differences in microstructures (segregations).

In addition, in the event of wear, the portion of the mold surrounding the radial recess 17 in question must be changed.

The invention makes it possible to provide a solution to the above-mentioned problem of segregations and, if necessary, to satisfy the requirements of withstanding the centrifugal forces and of quick and frequent changing of at least a portion of the mold.

FIGS. 4 to 15 show embodiments of a mold 130 of the invention, it being specified that FIG. 5 onwards diagrammatically show variant liners and exoskeletons suitable for replacing those shown in FIG. 4 around the central block 131. Regarding all of the functional means with which these embodiments of molds are preferably provided, they have neither been shown nor systematically reproduced in all of the variants described below, so as not to clutter the figures or make the following tedious. However, it remains that the details of these embodiments may be combined and may apply from one embodiment to another.

The mold 130 differs from the mold 13 in the way some of its structural means are implemented, in particular in the way its radial recesses for receiving the alloy are implemented.

Specifically, around the central block 131, which has L-shaped internal ducts 132 via which the alloy is brought to spread radially around the vertical central axis A, liners 135 (or, for example 135*a*, 135*b*, FIG. 4) are regularly spaced apart that, all together, define the above-mentioned recesses. The ducts 132 open out respectively into radial ducts 133 that receive the alloy via an opening 133*a* and each of which extends inside one of the liners, in a radial direction B. The opening 133*a* in each liner is thus situated in the radially inner end portion 134*a* of the duct in question.

The liners, which are thus hollow, are disposed in at least one exoskeleton 137, and preferably in as many exoskeletons as there are liners, each exoskeleton then containing a liner 135 defining one of said recesses.

The one or more exoskeletons retain the liners against the centrifugal forces generated by the spinning of the mold. Preferably they facilitate (or at least do not prevent) limitation of the thermal inertia.

In the preferred embodiment shown in FIG. 4, the central axis A of rotation of the mold is vertical and both the liners 135 and the exoskeletons 137 extend along a horizontal longitudinal axis (axis B).

For balance during the spinning, a concentric configuration (about the axis B) is recommended for each pair constituted by a liner 135 and by a peripheral exoskeleton 137.

At its radially outer end (end portion 134*b*), each duct 133 has a solid end wall 135*c*.

In comparable manner, at its radially inner end, each exoskeleton 137 has an opening 137*a* via which, for example, a liner 135 can pass and, at its radially outer end, each exoskeleton 137 has an end wall 137*b* that can participating in radially retaining the liner.

In FIG. 6, referenced 139*a*, 139*b*, are fastenings, which are releasable in this example, and which are established between the liner shown, in this example at 135*a*, and the exoskeleton, referenced 137*a* in this example, that surrounds it, in such a manner as to enable the liner to be replaced. Screw-fastenings may be suitable.

It can also be observed, in FIG. 4, that releasable fastenings are provided, such as 141*a*, 141*b* between each liner (and/or the exoskeleton that surrounds it, referenced 142*a*, 142*b*) and the central block 131.

Thus, it is possible to separate the liners from the exoskeletons and from the central block 131, in particular so as to replace said liners. Once again, screw-fastenings may be suitable.

The releasable fastenings established between liners and exoskeleton(s) and/or between the central block 131 and liners and/or exoskeleton(s) can form thermal bridge break zones.

In any event, in order to limit thermal inertia, as desired, it is recommended that the thermal behavior of the liners should be preponderant relative to the thermal behavior of the exoskeleton(s).

In a preferred embodiment, the exoskeleton(s) is/are made of mild steel, steels or alloys that are more or less refractory, and the liners are made of mild steel, steels or alloys that are more or less refractory and/or of ceramic.

In FIG. 7, the peripheral wall is referenced 135*d* and, at the center, it is possible to see the molded bar (blank) 110 resulting from the casting.

Figure 8:
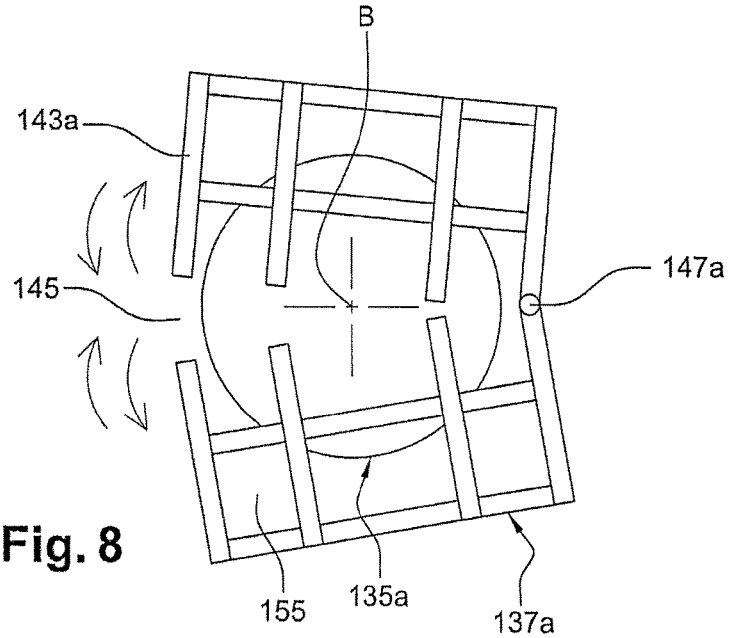

FIG. 8 shows a solution in which the exoskeleton 137*a* shown diagrammatically is provided with a moving door or gate 143*a* that, in the open position opens up an opening 145 enabling the liner in question, 135*a* in this example, to pass through it (in this example laterally relative to the radial axis B). Hinges, such as the one referenced 147*a*, may facilitate operating each moving door, and thus, for example, facilitate extraction of a worn liner from its exoskeleton and then insertion of another liner that is in a better state, as a replacement.

In FIGS. 4 to 8, it can also be observed that the exoskeletons is/are open-work.

They are thus a like cages or crates with mesh-like structures.

To facilitate low thermal inertia, provision is made in this example for an empty space 155 to exist peripherally (about the axis B) between each liner, such as 135*a*, and the exoskeleton, such as 137*a*, that surrounds it.

Centering means 157 position the liner in question in fixed manner relative to the exoskeleton, at least while the mold is spinning, for the centrifugal casting (see FIG. 5).

Figure 9:
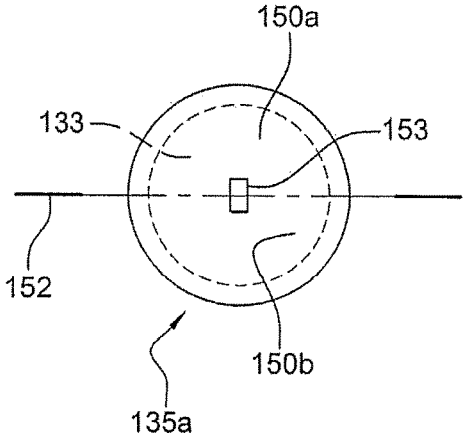
Figure 10:
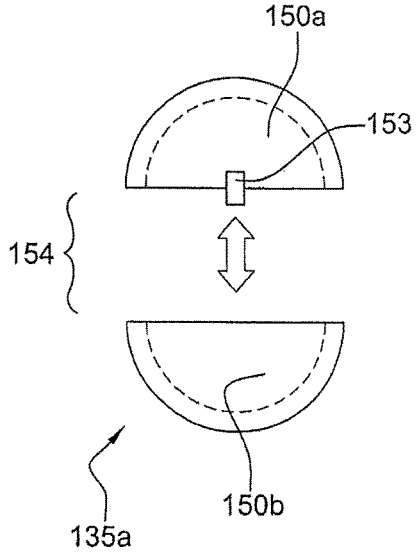

FIGS. 9 and 10 show yet another solution in which each of the liners is formed of a plurality of shells, such as 150*a*, 150*b* for the liner 135*a* shown diagrammatically.

The respective inside surfaces of the shells, as brought together, define at least the major portion of the molded bar 110.

These shells open and close along a join surface of the shells, such as the join plane 152. Thus, one of the shells (such as 135*a*) may constitute a moving or removable door relative to the other, making it possible to unmold the piece.

In addition, a separable fastening 153, such as a latch, is established between the shells so that, once the shells are separated, it is possible to extract the bar 110 from the inside of the liner in question, 135*a* in this example, via the opened-up opening 154.

Figure 11:
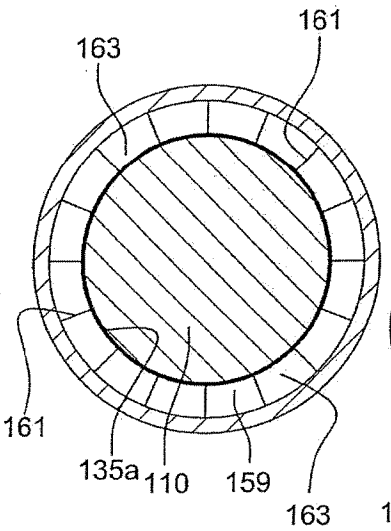

In the solution shown in FIGS. 11 and 12, a cellular or honeycomb structure 159 that extends peripherally between each liner, such as 135*a*, and the exoskeleton that surrounds it, such as 137*a*, plays this role, and thus defines at least some or a portion of the above-mentioned centering means 157.

The cellular structure 159 may be annular. It may occupy a space between the end walls 135*c* of the liners and the end wall 137*b* of the exoskeleton in question (FIG. 12).

Including for the desired heat transfers, FIG. 13 shows that the liner in question and the cellular structure, such as 159, are in contact via discrete zones, such as 159*a*, 159*b*.

Rather than them being in distinct pieces, provision could be made for the liner and the cellular structure to be in one piece (FIG. 13), so that they meet via said discrete zones situated at the radially inner ends of the walls 161 separating the cavities 163 of the cells in pairs, which cavities are, overall, equivalent to the above-mentioned space 155.

By way of an alternative, it is possible to form each liner, such as 135*a*, said structure 159 that surrounds it and the exoskeleton, such as 137*a*, that surrounds said structure, in three distinct elements that are mutually dissociable, the liner and the structure being engaged in the exoskeleton, concentrically, along a radial B to the axis A.

Figure 15:
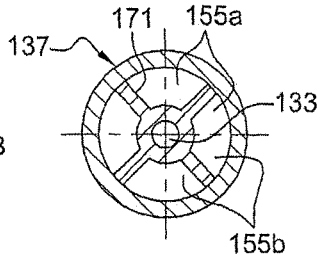

In FIGS. 14 and 15, but this can also apply to the preceding situations, each of the exoskeletons, such as 137*a*, has a radially outer end 134*b* (FIG. 14) in the vicinity of which the liner 135 bears radially against a transverse surface 165 of the exoskeleton.

The transverse surface 165 is preferably an internal shoulder of the exoskeleton.

The radially outer end 134*b* may be open, the exoskeleton then resembling a structure through which at least one passageway extends, and in which the liner in question is received.

A separate cap 167 (which may be removable) then closes off said radially outer end 134*b* in the manner of the above-mentioned end-wall 135*a*.

Favorably, the/each cap 167 does not penetrate into the exoskeleton beyond the transverse surface 165. Thus, the liner does not come to bear against it, which is preferable while it is spinning for the centrifugal casting.

At least in the situation shown in FIGS. 14 and 15, the outer structure, in particular the structure made up of one or more exoskeletons, of the mold may be a tubular cylindrical structure. It is favorably made of mild steel. An insert (the above-mentioned liner) is slid axially into it, which insert is made of a metal material or of a ceramic that is more or less refractory and may comprise shells (such as half-shells), as mentioned above.

It can be understood that this makes it possible:
for the insert to ensure that the desired geometrical shape is obtained for the cast piece, and to enable its solidification to be controlled, by controlling the temperature stresses; and
and for the outer structure to position the mold in the centrifugal casting setup and provide mechanical strength for the overall assembly.

For axial assembly/disassembly, a slope of at least one degree is preferably provided between the structure and the insert. This makes it possible to insert/remove the liner along the exoskeleton, along the axis B, while centering them coaxially, in mutual contact with each other. A releasable fastening is also established de facto (by clamping) between the liner and the exoskeleton that surrounds it. The internal volumes of the liners 135 may be of simple geometrical shape (cylinder, rectangle, cone, or combinations) or of complex geometrical shape. Generally, any shape unmoldable in the closure plane of the half-shells is, a priori, acceptable.

In order to preserve control over the temperature stresses, preferably in combination with control over the forces, it is recommended that, transversely to the radial direction in which they extend (axis B of the liner in question), each of the liners has at least a thickness that varies in said radial direction (length L) and that is, at least overall, smaller in the vicinity of at least one of the radially inner and outer ends, 134*a*, 134*b*, than in the intermediate portion, as shown in FIG. 14; see also thicknesses e1, e2, and e3. In other words, it is then possible, along an axis B, to find a shape 133 firstly of section tapering from the end 133*a*, towards an intermediate zone, and then optionally (FIG. 14), flaring towards the opposite end 133*b*.

If necessary, in association with this aspect (but this could be for a preferred cast piece shape), FIG. 14 shows the advantage of having a mold in which, individually, the open radially inner end 133*a* of the central duct 133 for casting the alloy of all or some of the liners 135 has a shape 169 of section tapering towards the center of the liner, in the radial direction B, in which the corresponding liner extends. It should be noted that the shape 169 can thus be a single funnel shape or a double funnel shape (the two funnels being disposed head-to-tail). A truncated cone could be appropriate. However, this funnel/chute shape is not necessarily circularly symmetrical.

As regards the radially outer portion of this duct, close to the end 134*b* (FIG. 14), it could be provided with a shoulder so as to have a wider end portion 133*b*.

Typically, if at least one blade, e.g. a Low-Pressure (LP) blade is subsequently machined from the cast bar, the funnel/chute shape could correspond to the tip butt zone of said blade and the wider end portion 133*b* could correspond to the wider root zone.

Also for the purpose of controlling the forces and of saving weight, in association with the controlled variation in the thickness of the liner, or indeed for the purpose of controlling temperature stresses, it is also specified that, individually, all or some of the liners 135 could, transversely to the radial direction B in which they extend, have a radial peripheral surface 170 that is at least locally (or partially) machined, as shown diagrammatically in FIG. 15.

In this figure, it can also be observed that longitudinal reinforcements 171 may be provided to procure stiffness, centering, and/or guiding for the liner 135 in question in the peripheral structure 137. The reinforcements project radially relative to the remainder of the liner in question.

Positioning the reinforcements 171 towards the radial ends 134*a*, 134*b* makes it possible to free up intermediate zones along the length of the mold, where the presence of at least one (empty) space 155 is favorable to controlling stresses, including temperature stresses.

In FIG. 15, the reinforcements 171 are radial to the axis of the liner shown diagrammatically and they define between them a plurality of empty spaces or secondary cavities, such as 155*a*, 155*b*.

For using the mold under a vacuum, with these one or more empty spaces or secondary cavities 155*a*, 155*b* established between the peripheral structure 137 and the outside face of the liner 135 in question, including for the outside surfaces of the machined half-shells, it is recommended to connect the space 155 to the outside air.

For this purpose, it is proposed for said space 155 to be in fluid communication with the outside environment of the mold via at least one orifice 175. In a particular embodiment, each liner 135, 135*a*, . . . may have a length L or axial dimension (axis B) lying in the range 10 centimeters (cm) to 50 cm, an outside section (such as a diameter) lying in the range 5 cm to 20 cm, an inside section (such as a diameter) lying in the range 4 cm to 10 cm, and a radial thickness e, e1, . . . lying in the range 1 cm to 10 cm, on average at any given section.

The invention claimed is:

1. A rotary mold mounted to spin about an axis, for centrifugal casting of an alloy, the mold comprising:

a plurality of liners, each defining a recess for receiving the alloy, and extending radially about said axis; and at least one exoskeleton inside which the liners are disposed, and that retains said liners against a centrifugal force;

wherein, transversely to the radial direction in which each liner extends, a space exists peripherally between said liner and the exoskeleton that surrounds it.

2. A mold according to claim 1, further comprising a central block having ducts via which the alloy is cast, and which communicate with the insides of the liners, and a releasable fastening is established between the central block and at least one element chosen from each liner and the exoskeleton that surrounds said liner.

3. A mold according to claim 1, wherein at least one element chosen from among said at least one exoskeleton and the liners is individually provided with a moving door that, in the open position, opens up an opening making it possible to pass the liner in question through it, and a cast piece coming from the solidified cast alloy, respectively.

4. A mold according to claim 1, wherein the space is empty and centering zones position the liner in question in fixed manner relative to said at least one exoskeleton, for the casting.

5. A mold according to claim 1, wherein said at least one exoskeleton is open-work.

6. A mold according to claim 1, wherein the space is defined within a cellular structure extending peripherally between each liner and the exoskeleton that surrounds it.

7. A mold according to claim 6, wherein the liner in question and the cellular structure, which has walls separating the cavities, bear against each other.

8. A mold according to claim 6, wherein the liner in question and the cellular structure, which has walls separating the cavities, meet via discrete zones.

9. A mold according to claim 6, wherein the liner, said cellular structure and the exoskeleton that surrounds the cellular structure are three elements that are mutually dissociable, the liner and the cellular structure being engaged in the exoskeleton concentrically.

10. A mold according to claim 1, wherein the mold encloses a cast TiAl metal alloy and the liners are made of steel, of a metal alloy, and/or of a ceramic adapted so that such an alloy, in the molten state, can be cast into them.

* * * * *